US006557942B1

(12) United States Patent
Shieh

(10) Patent No.: US 6,557,942 B1
(45) Date of Patent: May 6, 2003

(54) COMBINATION LOUNGER WITH EASY ASSEMBLY AND DETACHING STRUCTURE

(75) Inventor: Lube Shieh, Tainan (TW)

(73) Assignee: First & Best Furniture Co., Ltd., Tainan Hsien (TW)

( * ) Notice: Subject to any disclaimer, the term of this patent is extended or adjusted under 35 U.S.C. 154(b) by 0 days.

(21) Appl. No.: 09/988,480

(22) Filed: Nov. 20, 2001

(51) Int. Cl.[7] ..... A47C 7/00

(52) U.S. Cl. ..... 297/440.15; 297/68; 297/83; 297/84

(58) Field of Search ..... 297/68, 83, 84, 297/440.15

(56) References Cited

U.S. PATENT DOCUMENTS 5,184,871 A * 2/1993 LaPointe et al. ..... 297/440.21
5,427,431 A * 6/1995 Saul et al. ..... 297/342
5,443,301 A * 8/1995 Lai ..... 297/195.1
5,704,686 A * 1/1998 May ..... 297/273
5,795,028 A * 8/1998 Dussia et al. ..... 248/220.1
5,890,767 A * 4/1999 Chang ..... 297/248
5,975,627 A * 11/1999 LaPointe et al. ..... 297/68
6,145,924 A * 11/2000 Mero et al. ..... 297/452.18
6,347,835 B1 * 2/2002 LaPointe et al. ..... 297/440.1
6,409,262 B1 * 6/2002 LaPointe ..... 297/452.18

* cited by examiner

*Primary Examiner*—Peter M. Cuomo
*Assistant Examiner*—Stephanie Harris

(57) ABSTRACT

A combination lounger is constructed to include a rotary base with an reclining mechanism, a hassock detachably fastened to angle plates at front links of the reclining mechanism of the rotary base by tie screws, two armrest and side panel units detachably fastened to supporting lugs at two sides of the reclining mechanism of the rotary base, a seat detachably connected between the armrest and side panel units by tie screws, and a padded backrest detachably secured to inclining bars of the reclining mechanism of the rotary base by a hooked joint.

1 Claim, 7 Drawing Sheets

COMBINATION LOUNGER WITH EASY ASSEMBLY AND DETACHING STRUCTURE

BACKGROUND OF THE INVENTION

The present invention relates to a lounger and, more particularly, to a combination lounger, which is detachable so that the parts thereof can be detached from one another to reduce delivery space, or for a replacement.

Regular loungers, club chairs, sofa chairs commonly have a seat, two armrests at two opposite lateral sides of the seat, and a padded backrest at the backside of the seat. These chairs are comfortable to sit. However, these chairs occupy much space during delivery because they are not detachable. Further, because of being not detachable, these chairs become useless when either part damaged.

SUMMARY OF THE INVENTION

The present invention has been accomplished to provide a combination lounger, which eliminates the aforesaid drawbacks.

It is one object of the present invention to provide a combination lounger, which is detachable.

It is another object of the present invention to provide a combination lounger, which enables the user to replace any of the parts thereof when damaged.

It is still another object of the present invention to provide a combination lounger, which enables the consumer to set the lounger with selected colors of parts.

To achieve these and other objects of the present invention, the combination lounger comprises a rotary base with an reclining mechanism, a hassock detachably fastened to angle plates at front links of the reclining mechanism of the rotary base by tie screws, two armrest and side panel units detachably fastened to supporting lugs at two sides of the reclining mechanism of the rotary base, a seat detachably connected between the armrest and side panel units by tie screws, and a padded backrest detachably secured to inclining bars of the reclining mechanism of the rotary base by a hooked joint.

DETAILED DESCRIPTION OF THE PREFERRED EMBODIMENT

Figure 1:
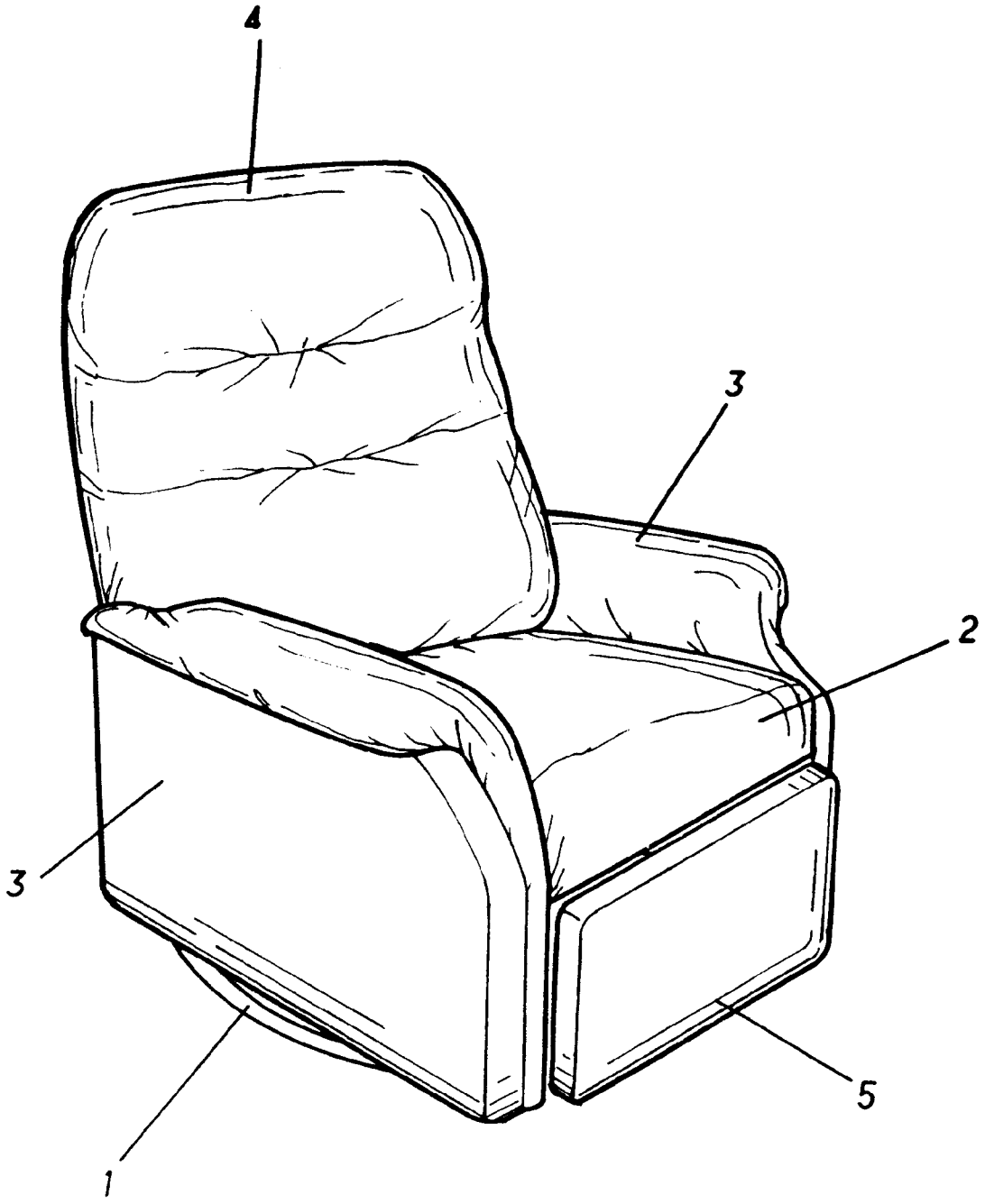
FIG. 1 is an elevational view of a combination lounger constructed according to the present invention.
Figure 2:
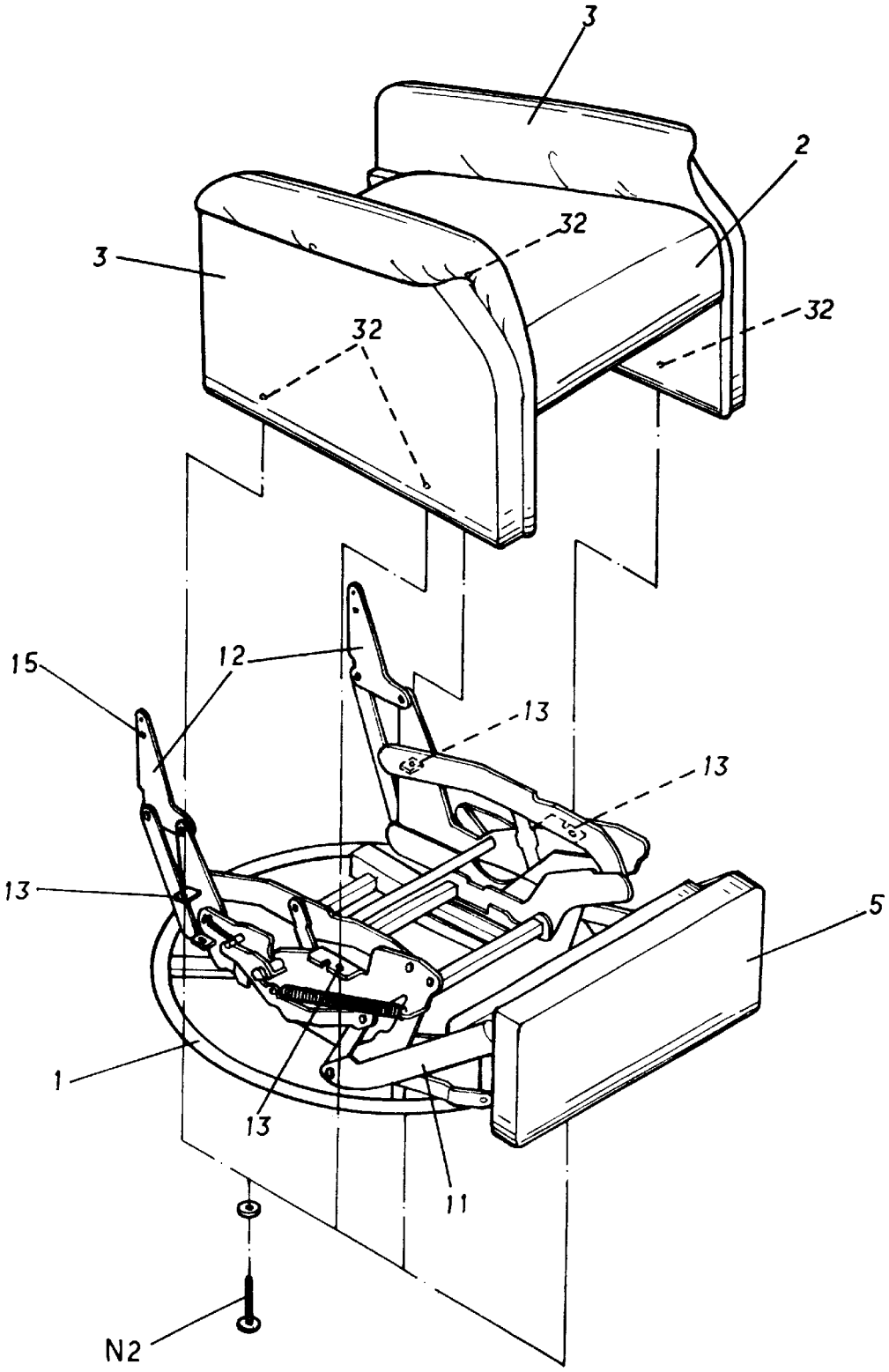
FIG. 2 is an exploded view of the combination lounger according to the present invention (the padded backrest excluded).

Referring to FIGS. 1 and 2, a lounger in accordance with the present invention is shown comprised of a rotary base 1, a seat 2, two armrest and side panel units 3, a padded backrest 4, and a hassock 5.

The rotary base 1 comprises a reclining mechanism having two front links 11 and two rear inclining bars 12 adapted for controlling the angle of inclination of the hassock 5 and the padded backrest 4 respectively. Because the reclining mechanism is of the known art and not within the scope of the present invention, it is not described in detail. The rotary base 1 further comprises two pair of supporting lugs 13 symmetrically provided at two sides of the reclining mechanism, and two angle plates 14 respectively coupled to the front links 11 (see FIG. 3). Further, the rear inclining bars 12 each have a protruded retaining portion 15 (see FIGS. 2 and 5).

Figure 4:
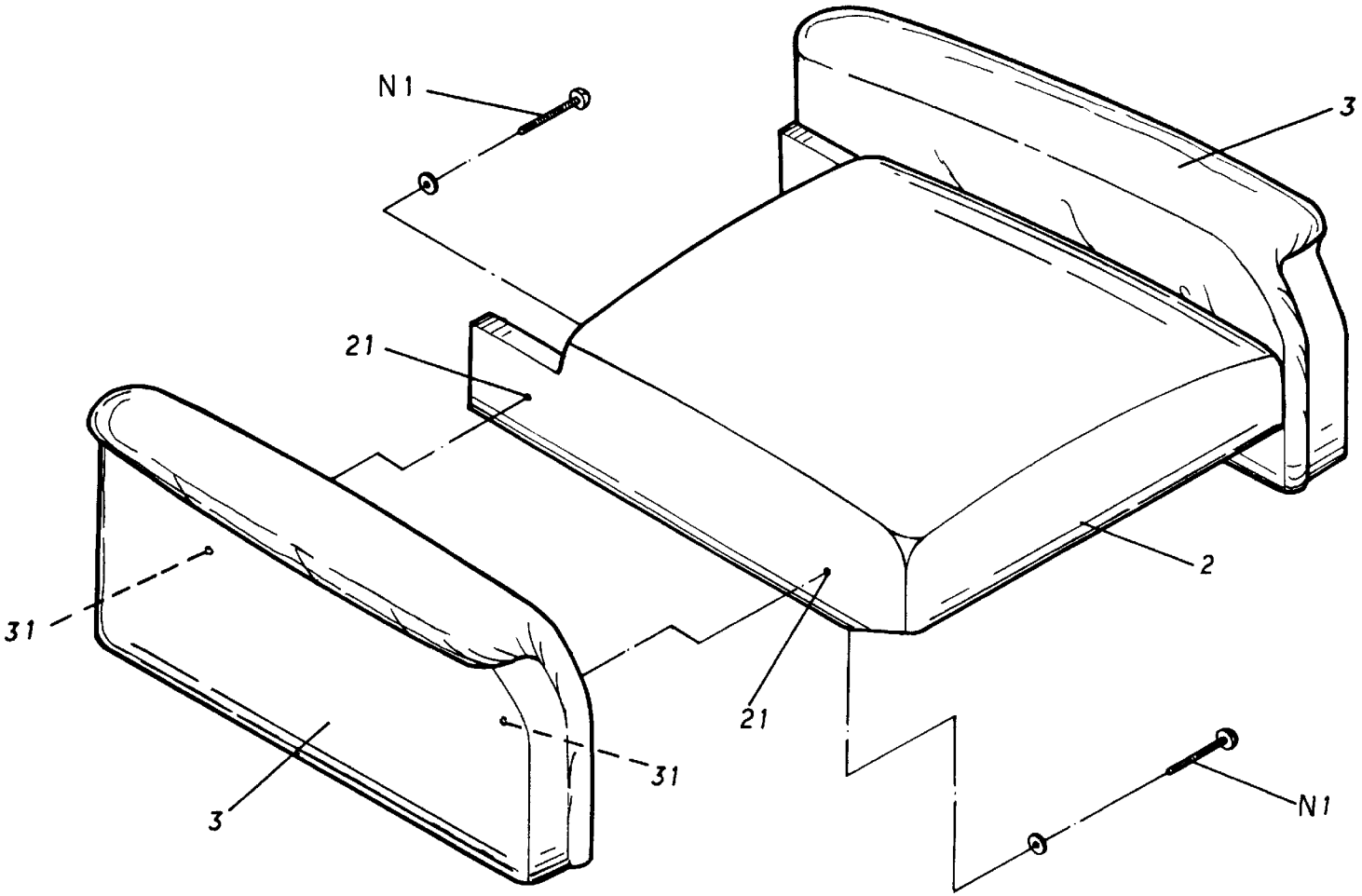
FIG. 4 is an exploded view of a part of the present invention showing the relationship between the armrest and side panel units and are seat.

The seat 2 comprises a plurality of mounting through holes 21 symmetrically disposed at two opposite lateral sides thereof (see FIG. 4).

Figure 9:
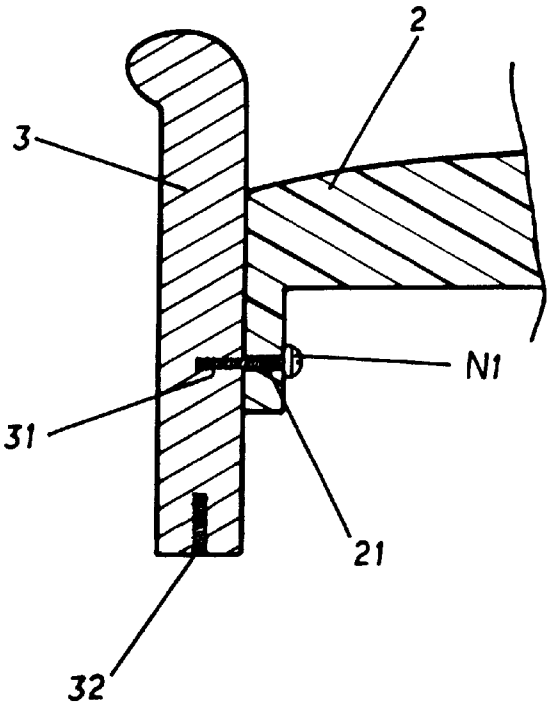
FIG. 9 is a sectional assembly view of a part of the present invention showing the armrest and side panel unit fastened to one side of the seat.

The armrest and side panel units 3 each have a plurality of first screw holes 31 respectively disposed in the inner sidewall thereof corresponding to the mounting through holes 21 of the seat 2, and a plurality of second screw holes 32 in the bottom sidewall thereof (see FIGS. 2 and 9).

Figure 5:
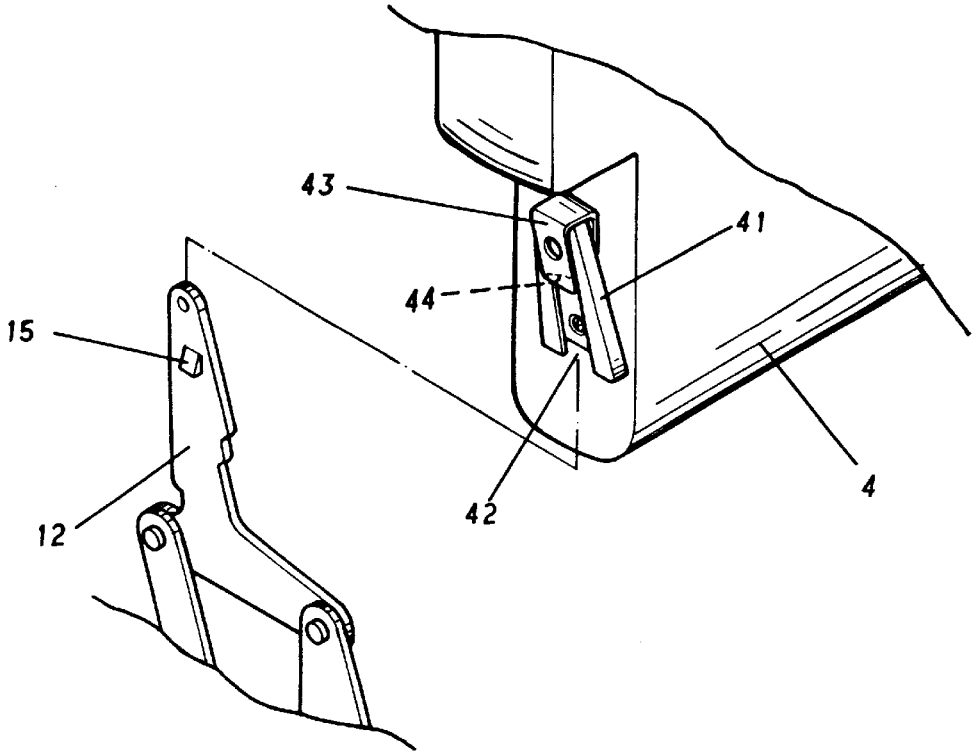
FIG. 5 is an exploded view of a part of the present invention showing the relationship between the padded backrest and the reclining mechanism.

The padded backrest 4 comprises two fixed receiving frames 41 symmetrically disposed at two opposite lateral sides thereof near the bottom, each receiving frame 41 defining a downward coupling hole 42, and two retaining spring plates 43 respectively fixedly fastened to the fixed receiving frames 41 at a top side, each retaining spring plate 43 having a free end terminating in a hooked portion 44 and suspending in the coupling hole 42 of the corresponding fixed receiving frame 41 (see FIG. 5).

Figure 3:
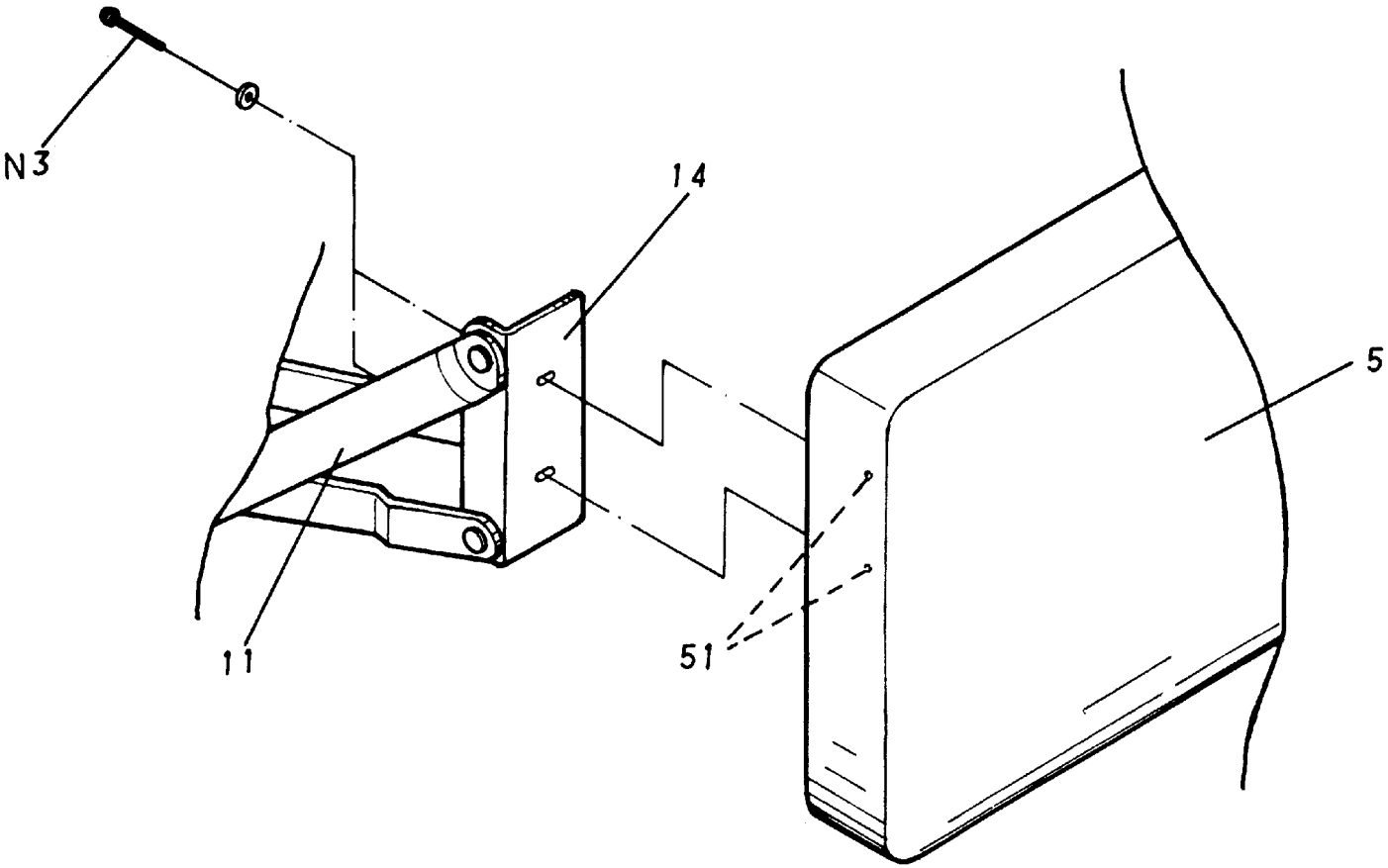
FIG. 3 is an exploded view of a part of the present invention showing the relationship between the hassock and the angle the front links of the reclining mechanism.

The hassock 5 comprises a plurality of screw holes 51 symmetrically bilaterally disposed in the back sidewall thereof (see FIG. 3).

Figure 6:
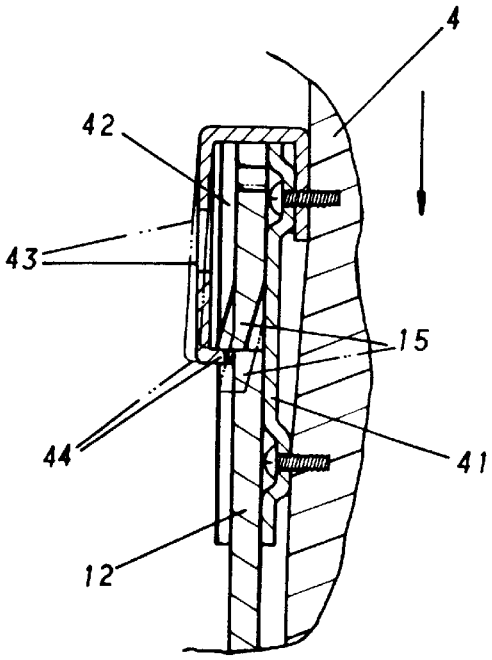
FIG. 6 is a sectional assembly view of a part of the present invention showing the padded backrest fastened to the reclining mechanism.
Figure 7:
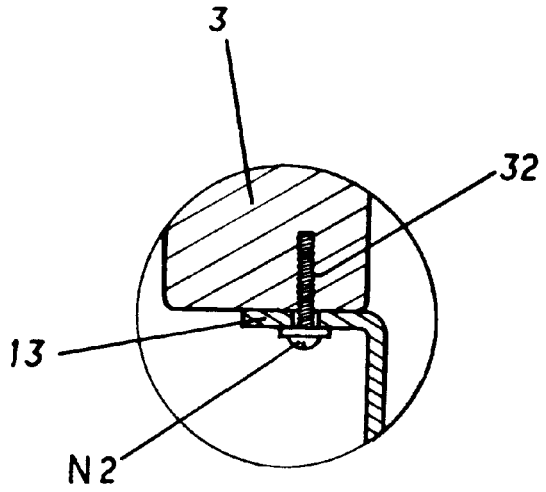
FIG. 7 is a sectional assembly view of a part of the present invention showing one armrest and side panel unit fastened to one supporting of the rotary base.
Figure 8:
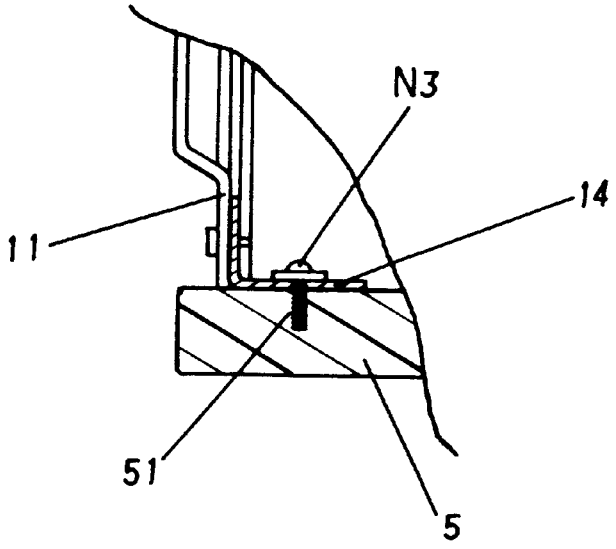
FIG. 8 is a sectional assembly view of a part of the present invention showing the hassock fastened to the angle plates.

During assembly, the armrest and side panel units 3 are respectively attached to the two opposite lateral sides of the seat 2, and tie screws N1 are respectively mounted in the mounting through holes 21 of the seat 2 and threaded into the first screw holes 31 of the armrest and side panel units 3 to fix the seat 2 and the armrest and side panel units 3 together (See FIGS. 4 and 9), and then the armrest and side panel units 3 are respectively attached to the supporting lugs 13 of the rotary base 1 and stopped at the front side of the rear inclining bars 12 for enabling the second screw holes 32 of the armrest and side panel units 3 to be respectively fastened to the supporting lugs 13 by respective tie screws N2 (see FIG. 7), and then the padded backrest 4 is inserted in between the armrest and side panel units 3 for enabling the rear inclining bars 12 of the rotary bar 1 to be respectively engaged into the coupling holes 42 of the fixed receiving frames 41 of the padded backrest 4 to force the retaining portions 15 of the rear inclining bars 12 into engagement with the hooked portions 44 of the retaining spring plates 43 respectively (See FIG. 6), and then tie screws N3 are respectively inserted through (respective through holes of) the angle plate 14 and threaded into the screw holes 51 of the hassock 5 to fixedly secure the hassock 5 to the angle plates 14 (see FIGS. 3 and 8).

When in use, the rotary base frame 1 is supported on the floor. The user can than sit on the seat 2 with the arms rested on the armrest and side panel units 3, the back supported on the padded backrest 4, and the legs rested on the hassock 5. By means of operating the reclining mechanism of the rotary base 1, the angle of inclination of the padded backrest 4 and the angle of inclination of the hassock 5 are respectively adjusted.

Figure 10:
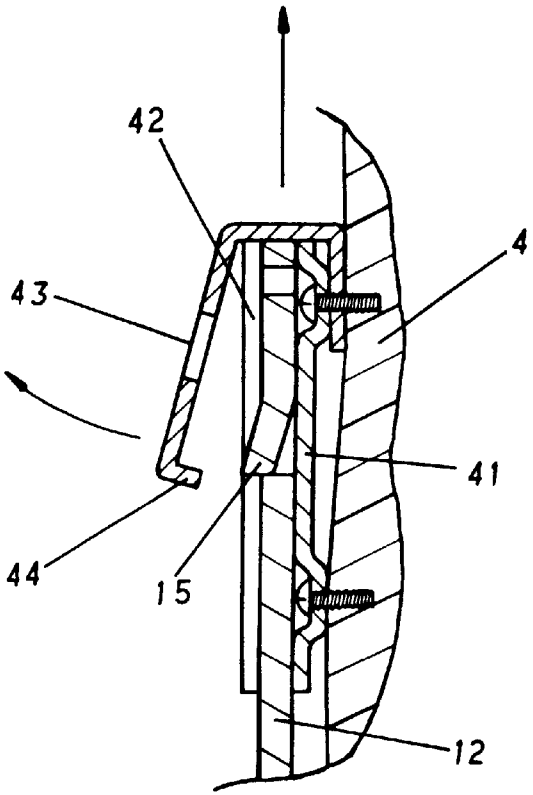
FIG. 10 is a schematic drawing showing the retaining spring plate pulled outwards, the hooked portion of the retaining spring plate disengaged from the retaining portion of the corresponding rear inclining bar according to the present invention.

When not in use or when wishing to deliver the lounger to a far place, the retaining spring plates 43 are pulled outwards to disengage the retaining spring plates 43 from the retaining portions 15 of the rear inclining bars 12 (see FIG. 10), for enabling the padded backrest 4 to be disconnected from the rear inclining bars 12 of the rotary base 1, and then the tie screws N2 are removed, for enabling the armrest and side panel units 3 with the seat 2 to be disconnected from the rotary base 1, and then the tie screws N3 are removed, for enabling the hassock 5 to be disconnected from the angle plates 14, and then the tie screws N1 are removed, for enabling the armrest and side panel units 3 to be disconnected from the seat 2.

When either member of the seat 2, the armrest and side panel units 3, the padded backrest 4, and the hassock 5 is damaged, it can be detached from the lounger for a replacement. The lounger manufacturer can prepare the detachable parts (the seat 2, the armrest and side panel units 3, the padded backrest 4, and the hassock 5) in different colors for choice, so that the consumers can select the desired colors to set up a colorful combination lounger.

A prototype of combination lounger has been constructed with the features of FIGS. 1~10. The combination lounger functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A combination lounger with easy assembly and detaching structure comprising:

a rotary base, said rotary base comprising a reclining mechanism having two front links and two rear inclining bars, a plurality of supporting lugs symmetrically disposed at two sides, and two angle plates respectively coupled to said front links;

a seat, said seat comprising a plurality of mounting through holes symmetrically disposed at two opposite lateral sides thereof;

two armrests and side panel units adapted for supporting said seat on the supporting lugs of said rotary base, said armrest and side panel units each comprising a plurality of first screw holes disposed at an inner side and adapted for connecting to the mounting through holes of said seat by respective tie screws, and a plurality of second screw holes disposed at a bottom side and adapted for connecting to the supporting lugs of said rotary base by respective tie screws;

a padded backrest adapted for connecting to said rear inclining bars of said reclining mechanism of said rotary base; and a hassock, said hassock comprising a plurality of screw holes bilaterally disposed in a back sidewall thereof and adapted for connecting to said angle plates by respective tie screws; characterized in that:

each of said rear inclining bars has a retaining portion protruded from the rear inclining bar;

said padded backrest comprises two fixed receiving frames respectively disposed at two opposite lateral sides thereof;

two retaining spring plates each having a U shape and having two ends, one end of each retaining spring plate is connected to the fixed receiving frames, and the other end of each retaining spring plate is a free end;

wherein in assembly, said rear inclined bar is inserted into a space between said retaining spring plates and said fixed receiving frames; said retaining portions will be enforced into said space and then is buckled by said free end of the retaining spring plates, if it is desired to detach the rear inclined bar, it is only necessary to move said free end of said retaining spring plate outward, and then the rear inclined bar is drawn out of said space between said retaining spring plate and said fixed receiving frame.

* * * * *